US006428858B1

(12) United States Patent
Bolton et al.

(10) Patent No.: US 6,428,858 B1
(45) Date of Patent: Aug. 6, 2002

(54) WIRE FOR THERMAL SPRAYING SYSTEM

(76) Inventors: Jimmie Brooks Bolton, 10459 Twin Circles, Montgomery, TX (US) 77356; Billi Marie Rogers, 10211 Chevy Chase Dr., Houston, TX (US) 77042

( * ) Notice: Subject to any disclaimer, the term of this patent is extended or adjusted under 35 U.S.C. 154(b) by 0 days.

(21) Appl. No.: 09/769,555

(22) Filed: Jan. 25, 2001

(51) Int. Cl.[7] ..... C23C 4/06
(52) U.S. Cl. ..... 427/449; 427/455; 427/456
(58) Field of Search ..... 427/456, 455, 427/449; 219/145.1, 146.22

(56) References Cited

U.S. PATENT DOCUMENTS

| | | | | |
|---|---|---|---|---|
| 3,332,753 A | | 7/1967 | Batchelor et al. | |
| 3,436,248 A | | 4/1969 | Dittrich et al. | |
| 3,579,313 A | | 5/1971 | Pryor et al. | |
| 3,600,790 A | | 8/1971 | Dion et al. | 29/474.1 |
| 3,602,633 A | | 8/1971 | Miller et al. | 174/36 |
| 3,631,586 A | | 1/1972 | Bearpark et al. | 29/474.3 |
| 3,648,356 A | | 3/1972 | Ziemek | 29/474.1 |
| 3,666,879 A | | 5/1972 | Hirsch et al. | 174/128 |
| 3,683,103 A | | 8/1972 | Mancino | 174/119 C |
| 3,777,361 A | | 12/1973 | Fuchs, Jr. | 29/470.6 |
| 3,778,895 A | | 12/1973 | Nomura et al. | 29/599 |
| 3,841,901 A | * | 10/1974 | Novinski et al. | 117/105.2 |
| 3,900,695 A | | 8/1975 | Andersson et al. | 13/26 |
| 3,949,466 A | | 4/1976 | O'Brien et al. | 29/628 |
| 4,013,211 A | | 3/1977 | Atman | 228/126 |
| 4,284,841 A | | 8/1981 | Tijunelis et al. | 174/103 |
| 4,372,988 A | | 2/1983 | Bahder | 427/52 |
| 4,390,589 A | | 6/1983 | Geyling et al. | 428/381 |
| 4,484,023 A | | 11/1984 | Gindrup | 174/102 |
| 4,515,992 A | | 5/1985 | Gupta | 174/102 |
| 4,751,113 A | * | 6/1988 | Riccio et al. | 427/404 |
| 5,174,222 A | | 12/1992 | Rogers | 114/222 |
| 5,189,719 A | | 2/1993 | Coleman et al. | 385/101 |
| 5,286,577 A | | 2/1994 | Premkumar et al. | 428/558 |
| 5,294,462 A | * | 3/1994 | Kaiser et al. | 427/446 |
| 5,945,171 A | * | 8/1999 | Cook | 427/456 |
| 6,190,740 B1 | * | 2/2001 | Rogers | 427/446 |

FOREIGN PATENT DOCUMENTS

EP 035 377 * 9/1981

OTHER PUBLICATIONS

Thermal Spraying: Practice, Theory, and Application, American Welding Society, Inc. p. 54, 1985, (No month date).*
Thermal Spraying: Practice, Theory, and Application, American Welding Society, Inc. 1985, p. 61, (No month date).*
LASERCARB, Technogenia S.A., 1999, (No month date).
Hard Facing, Technogenia S.A., 1999, (No month date).
High Performance Tungsten—Carbide Based Hardfacing, Technogenia S.A., 1999, (No month date).

* cited by examiner

*Primary Examiner*—Katherine A. Bareford
(74) *Attorney, Agent, or Firm*—Guy McClung

(57) ABSTRACT

A wire for use in thermal spraying, the wire having sheath material—e.g. zinc, zinc alloy, aluminum and/or aluminum alloy, and core material, e.g. copper and/or copper alloy. A method for thermal spraying, the method including spraying a coating onto an object (e.g. but not limited to a vessel's hull with a thermal spray system, the thermal spray system using such wire or powder to produce the coating, the wire or powder including first material acting as a cathode and second material acting as a biocide for marine growth.

10 Claims, 8 Drawing Sheets

Table I

| Al A # | Si | Fe | Cu | Mn | Mg | Cr | Ni | Zn | Ti |
|---|---|---|---|---|---|---|---|---|---|
| 1100 | 1.0 Si + Fe | | 0.20 | 0.05 | --- | --- | --- | 0.10 | --- |
| 2014 | 0.50-1.2 | 1.0 | 3.9-5.0 | 0.40-1.2 | 0.20-0.8 | 0.10 | --- | 0.25 | 0.15 |
| 3004 | 0.30 | 0.7 | 0.25 | 1.0-1.5 | 0.8-1.3 | --- | --- | 0.25 | --- |
| 4032 | 11.0-13.5 | 1.0 | 0.50-1.3 | --- | 0.8-1.3 | 0.10 | 0.50-1.3 | 0.25 | --- |
| 4043 | 4.5-6.0 | 0.8 | 0.30 | 0.05 | 0.05 | --- | --- | 0.10 | 0.20 |
| 5050 | 0.40 | 0.7 | 0.20 | 0.10 | 1.0-1.8 | 0.10 | --- | 0.25 | --- |
| 6063 | 0.20-0.6 | 0.35 | 0.10 | 0.10 | 0.45-0.9 | 0.10 | --- | 0.10 | 0.10 |
| 7075 | 0.50 | 0.7 | 1.2-2.0 | 0.30 | 2.1-2.9 | 0.18-0.40 | --- | 5.1-6.1 | 0.20 |

Fig. 7

Table III

| Common Name | Nominal Chemistry | Trade Name |
|---|---|---|
| Pure Zinc | | |
| AG40A Alloy | 4% Al - 0.04% Mg | Zanak-3 (die casting) |
| AC41A Alloy | 4% Al - 1% Cu - 0.04% Mg | Zamak-5 (die casting) |
| Zinc-base slush-casting alloy | 4.75% Al - 0.25% Cu | |
| Zinc-base slush-casting alloy | 5.5% Al | |
| Commercial rolled zinc | 0.08% Pb | Deep drawing zinc |
| Commercial rolled zinc | 0.06% Pb - 0.06% Cd | |
| Commercial rolled zinc | 0.3% Pb - 0.3% Cd | |
| Copper-hardened rolled zinc | 1% Cu | Zilloy-40 |
| Rolled zinc alloy | 1% Cu 0 0.10% Mg | Zilloy-15 |
| Zn-Cu-Ti alloy | 0.8% Cu - 0.15% Ti | |

Fig. 9

Fig. 8 Table II

| Common Name | Nominal Chemistry | Trade Name |
|---|---|---|
| Electrolytic copper | 99.95 Cu - 0.04 O | Electrolytic tough pitch copper |
| Deoxidized copper, low residual phosphorous (DLP) | 99.92 Cu 0.009 P | --- |
| Deoxidized copper, high residual phosphorous (DHP) | 99.95 Cu 0.02 P | Phosphorized copper; High residual phosphorous |
| Oxygen-Free Copper (OF) | 99.95 Cu | --- |
| Free-Machining Copper | 0.5% Te | Tellurium copper |
| Free-Machining Copper | 1.0 Pb | Leaded copper |
| Silver-Bearing Copper | No. oz / ton X 0.00343 for oz Ag | --- |
| Gilding 95% | 95 Cu - 5 Zn | Gilding metal |
| Commercial bronze 90% | 90 Cu - 10 Zn | --- |
| Jewelry bronze 87.5% | 87.5 Cu - 12.5 Zn | --- |
| Red brass 85% | 85 Cu -15 Zn | --- |
| Low brass 80% | 80 Cu - 20 Zn | --- |
| Cartridge brass 70% | 70 Cu - 30 Zn | Cartridge brass; Spinning brass, Spring brass |
| Yellow brass | 65 Cu - 35 Zn | Drawing brass, Common high brass; Hoop brass |
| Muntz metal | 60 Cu - 40 Zn | --- |
| Leaded commercial bronze | 89 Cu - 9 Zn 1.75 Pb | --- |
| Low-leaded brass (tube) | 66 Cu - 33.5 Zn 0.5 Pb | High brass; Yellow brass |
| Medium-leaded brass | 65 Cu - 34 Zn 1 Pb | Butt brass; Matrix brass; Semi-lead brass; swaging brass |
| High-leaded brass (tube) | 66 Cu - 32.4 Zn 1.6 Pb | Free-cutting tube brass; Leaded high brass |
| High-leaded brass | 65 Cu - 33 Zn 2 Pb | Clock brass; Engraver's brass; Heavy-leaded brass |

Fig. 8 Table II - Cont'd

| Common Name | Nominal Chemistry | Trade Name |
|---|---|---|
| Extra-high-leaded brass | 63 Cu - 34.5 Zn - 2.5 Pb | --- |
| Free-cutting brass | 61.5 Cu - 35.5 Zn - 3 Pb | Free-turning brass; Free-cutting yellow brass; High-leaded brass |
| Leaded Muntz metal | 60 Cu - 39.4 Zn - 0.6 Pb | --- |
| Forging bronze | 59 Cu - 39 Zn - 2 Pb | --- |
| Architectural bronze | 57 Cu - 40 Zn - 3 Pb | --- |
| Inhibited Admiralty | 71 Cu - 28 Zn - 1 Sn | Admiralty brass |
| Naval brass | 60 Cu - 39.25 Zn 0.75 Sn | --- |
| Leaded naval brass | 60 Cu - 37.5 Zn 1.75 Pb - 0.75 Sn | Leaded naval brass, grade C |
| Manganese bronze | 58.5 Cu - 39 Zn - 1.4 Fe 1 Sn - 0.1 Mn | --- |
| Phosphor bronze, 5%<br>Phosphor bronze, 8%<br>Phosphor bronze, 10%<br>Phosphor bronze, 1.25% | 95 Cu - 5 Sn<br>92 Cu - 8 Sn<br>90 Cu - 10 Sn<br>98.75 Cu - 1.25 Sn | ---<br>---<br>---<br>--- |
| Free-cutting phosphor bronze | 88 Cu - 4 Pb 4 Sn - 4 Zn | 444 bronze; Bearing bronze |
| Cupro-nickel, 30%<br>Cupro-nickel, 10% | 70 Cu - 30 Ni<br>88.7 Cu - 10 Ni - 1.3 Fe | ---<br>--- |
| Nickel-silver, 65-18 | 65 Cu - 18 Ni - 17 Zn | --- |
| Nickel-silver, 55-18 | 55 Cu - 27 Zn - 18 Ni | --- |
| Nickel-silver, 65-12 | 65 Cu - 23 Zn - 12 Ni | --- |
| High-silicon bronze | 96 Cu - 3 Si | Copper-silicon alloy; High-silicon bronze |
| Low-silicon bronze | 97.7 Cu - 1.5 Si | --- |

Fig. 8 Table II - Cont'd

| Common Name | Nominal Chemistry | Trade Name |
|---|---|---|
| Aluminum bronze | 95 Cu - 5 Al | 5% Aluminum bronze |
| Aluminum bronze | 91 Cu - 7 Al - 2 Fe | --- |
| Aluminum bronze | 91 Cu - 9 Al | 9% Aluminum bronze |
| Aluminum bronze | 81.5 Cu - 9.5 Al<br>5 Ni - 2.5 Fe - 1 Mn | --- |
| Aluminum-silicon bronze | 91 Cu - 7 Al - 2 Si | --- |
| Beryllium copper | 97.9 Cu - 1.9 Be -<br>0.2 Ni or Co | Beryllium copper |
| Chromium copper | 1% Cr | --- |
| Tin bronze alloy<br>Tin bronze alloy<br>Tin bronze alloy | 88 Cu - 10 Sn - 2 Zn<br>88 Cu - 8 Sn - 4 Zn<br>89 Cu - 11 Sn | ---<br>---<br>Phosphor gear bronze |
| Navy M bronze alloy | 88 Cu - 6 Sn<br>1 ½ Pb - 4 ½ Zn | Navy M, Stream or Valve bronze |
| Leaded tin bronze | 87 Cu - 8 Sn - 1 Pb - 4 Zn | --- |
| Leaded tin bronze | 87 Cu - 10 Sn - 1 Pb - 2 Zn | --- |
| High-lead tin bronze alloy | 80 Cu - 10 Sn - 10 Pb | Bushing and Bearing bronze |
| High-lead tin bronze alloy | 83 Cu - 7 Sn<br>7 Pb - 3 Zn | --- |
| High-lead tin bronze alloy | 85 Cu - 5 Sn<br>9 Pb - 1 Zn | --- |
| High-lead tin bronze alloy | 78 Cu - 7 Sn - 15 Pb | --- |
| High-lead tin bronze alloy | 70 Cu - 5 Sn - 25 Pb | --- |

Fig. 8

Table II - Cont'd

| Common Name | Nominal Chemistry | Trade Name |
|---|---|---|
| Leaded red brass alloy | 85 Cu - 5 Sn<br>5 Pb - 5 Zn | Ounce metal; Composition metal |
| Leaded red brass alloy | 83 Cu - 4 Sn<br>6 Pb - 7 Zn | Hydraulic bronze |
| Leaded semi-red brass | 81 Cu - 3 Sn<br>7 Pb - 9 Zn | Valve metal |
| Leaded semi-red brass alloy | 76 Cu - 2 ½ Sn<br>6 ½ Pb - 15 Zn | Plumbing goods brass |
| Leaded yellow brass alloy | 72 Cu - 1 Sn<br>3 Pb - 24 Zn | High-copper yellow brass |
| Leaded yellow brass alloy | 67 Cu - 1 Sn<br>3 Pb - 29 Zn | No. 1 yellow brass |
| Leaded yellow brass alloy | 61 Cu - 1 Sn<br>1 Pb - 37 Zn | Die cast brass (ingot) |
| Manganese bronze (60,000 psi) | 59 Cu - 0.75 Sn<br>0.75 Pb - 37 Zn<br>1.25 Fe - 0.75 Al - 0.75 Mn | Stem manganese bronze; Leaded high-strength yellow brass |
| Manganese bronze (65,000 psi) | 57.5 Cu - 39.25 Zn<br>1.25 Fe - 1.25 Al - 0.25 Mn | High-strength yellow brass |
| Manganese bronze (90,000 psi) | 64 Cu - 24 Zn<br>3 Fe - 5 Al - 4 Mn | --- |
| Manganese bronze (110,000 psi) | 64 Cu - 26 Zn -<br>3 Fe - 5 Al - 4 Mn | High-strength yellow brass |
| Aluminum bronze alloy | 88 Cu - 3 Fe - 9 Al | --- |
| Aluminum bronze alloy | 89 Cu - 1 Fe - 10 Al | --- |
| Aluminum bronze alloy | 85 Cu - 4 Fe - 11 Al | --- |
| Aluminum bronze alloy | 81 Cu - 4 Fe - 11 Al<br>4 Ni | --- |
| Aluminum bronze | 82 Cu - 4 Fe - 9 Al<br>4 Ni - 1 Mn | Propeller bronze |

Fig. 8

Table II - Cont'd

| Common Name | Nominal Chemistry | Trade Name |
|---|---|---|
| Nickel Silver (12% Ni) | 57 Cu - 2 Sn - 9 Pb 20 Zn - 12 Ni | Leaded nickel brass; Benedict metal |
| Nickel Silver (16% Ni) | 60 Cu - 3 Sn - 5 Pb 16 Zn - 16 Ni | Leaded nickel brass |
| Nickel Silver (20% Ni) | 64 Cu - 4 Sn - 4 Pb 8 Zn - 20 Ni | Dairy bronze |
| Nickel Silver (25% Ni) | 66.5 Cu - 5 Sn 1.5 Pb - 2 Zn - 25 Ni | Leaded nickel bronze |
| Silicon bronze | 87 Cu - 4 Si - 1 Sn 4 Zn - 2 Fe - 1 Al- 1 Mn | --- |
| Silicon brass | 81 Cu - 4 Si - 15 Zn | --- |

WIRE FOR THERMAL SPRAYING SYSTEM

BACKGROUND OF THE INVENTION

1. Field of the Invention

The present invention is directed to wire for thermal spraying; to spraying systems for applying material coatings to a substrate; and in certain aspects to wire and coating made with it that inhibit marine growth and corrosion.

2. Description of Related Art

"Thermal spraying" refers to a variety of processes for depositing both metallic and non-metallic materials on a substrate to form a coating. Metals, cermets, ceramics, plastics and mixtures thereof in the form of powders, rods or wires may be used as coating material. Heat for melting the material is supplied by electric arc, plasma arc, or combustible fuel gases and compressed air or process gases form an accelerated stream of molten coating material. The material builds up on the substrate and cools to form the coating.

Electric arc spray processes use electrically charged wire which is fed by a wire feeder to an arc spray gun in which the wires converge, arc, and melt in a high temperature zone (e.g. 15,000 degrees F. or higher) created by the arc. A compressed air stream is directed to the arc zone and atomizes the molten material produced from the melting wire. The stream flows from the gun for coating onto a desired substrate.

Molten particle velocities average 100 meters per second; deposit thicknesses average 0.001 to 0.003 inches per pass; and deposition rates range between 10 to 40 pounds of material per hour depending on the material and the amperage. By compassing the arc in a gun head relatively little heat is transferred by the molten material tot he substrate. Sprayable materials include, but are not limited to, carbon steels, stainless steels, oxides, carbides, nickel alloys, copper, copper alloys, bronze, aluminum, aluminum alloys, zinc, babbitt, and molybdenum. Such materials may be spray to produce a coating or to rebuild a part.

SUMMARY OF THE PRESENT INVENTION

The present invention, in certain aspects, discloses a wire for thermal spraying that includes: 1. copper and/or copper alloy and 2. aluminum and/or aluminum alloy and/or zinc and/or zinc alloy . In one aspect such a wire has an outer sheath of pure aluminum (e.g. 1100 type aluminum) or of aluminum alloy. The outer sheath may, e.g., be made of materials as in Table I. In certain aspects the aluminum alloy contains at least 95% aluminum by weight. The wire, in certain aspects, has a core of pure copper or of copper alloy including, but not limited to copper alloyed with tin, zinc, nickel, manganese, iron and/or silicon. In certain aspects the copper alloy contains at least 80% copper by weight. The core may be made, e.g., of the materials in Table II.

The sheath, in certain aspects, has a thickness ranging between 0.010 inches and 0.020 inches for a wire, e.g., of 1/16m inches in diameter. The sheath for a wire of about 3/16 inches in diameter ranges between 0.010 inches and 0.150 inches thick. By weight the total material of the core, in certain embodiments, ranges between 1% and 60% of the wire's total weight. By weight the sheath, in certain embodiments, ranges between 40% and 99% of the total wire weight. The core may include both copper and copper alloy with copper present in a range of 1% to 60% by weight and copper alloy present in a range of 1% to 60% by weight of the total core weight. The sheath may include both aluminum and/or zinc and aluminum alloy and/or zinc alloy in a range of 40% to 99% by weight of the total sheath weight.

The core may be in powder form or it may itself be a solid wire. In certain embodiments the sheath as described above is made of zinc, zinc alloy, aluminum or aluminum alloy. In other aspects the sheath is made of a combination of any two or more of these materials. The sheath may be made, e.g. of any of the materials in Table III or of a combination of any two or more of them.

In certain embodiments, the wire is made by enclosing the core in the sheath. This can be done by any of the well-known cored wire making processes. Typical sheathed wire or core wire forming processes are disclosed in U.S. Pat. Nos. 3,777,361; 3,648,356; 3,631,586; 3,600,790; 3,436,248; 4,013,211; and the prior art cited in these patents—all of which are incorporated fully here for all purposes.

In other embodiments a wire according to the present invention is made by melting and combining the core material and sheath material to produce a solid combination of the two, in one aspect in the form of rods, and then extruding a wire of suitable diameter from the rods.

In other embodiments, a wire (or strand, filament) or wires of core material is twisted together with a wire or wires of sheath material to form a multi-component wire which has no outer sheath. Alternatively, such a multi-component wire may have an outer sheath of sheath material.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

- New, useful, unique, efficient, nonobvious wires and methods for thermal spraying;
- Such wires which have a core of core material and a sheath of sheath material as disclosed herein;
- Such wires made of one or more wires of core material and one or more wires of sheath material, with or without a sheath of sheath material; and
- Such wires used in thermal spraying systems to inhibit marine growth and corrosion.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which ate shown in the drawings which form a part of this specification. These drawings illustrate certain preferred embodiments and are not to be used to improperly limit the scope of the invention which may have other equally effective or legally equivalent embodiments.

FIGS. 7, 8 and 9 present, respectively, Tables I–III.

DESCRIPTION OF EMBODIMENTS PREFERRED AT THE TIME OF FILING FOR THIS PATENT

Figure 1A:
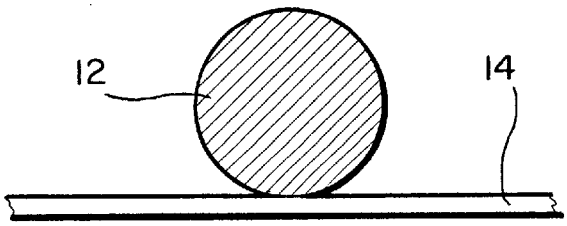
FIG. 1A shows schematically a process for forming a wire according to the present invention as shown in cross-section in FIG. 1B.
Figure 1B:
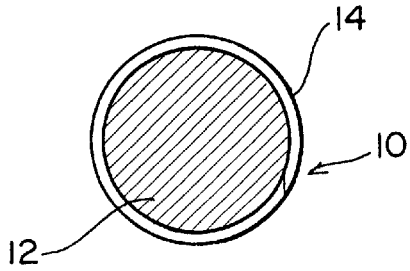

As shown in FIG. 1A, a solid wire 12 of copper, of copper alloy, or of a combination of copper and copper alloy is to be enclosed in an outer cladding or sheath 14 of aluminum, aluminum alloy, or a combination of the two. Any suitable known process for forming the resultant wire 10, FIG. 1B, may be used. In one aspect a known tube mill process is used to form a flat strip into a tube around a core, either powdered or solid.

Figure 2A:
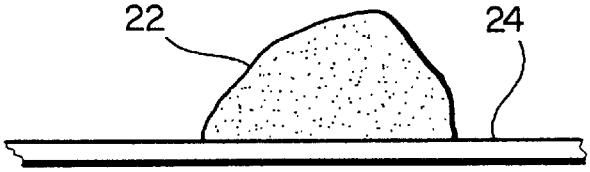
FIG. 2A shows schematically a process for forming a wire according to the present invention as shown in cross-section in FIG. 2B.
Figure 2B:
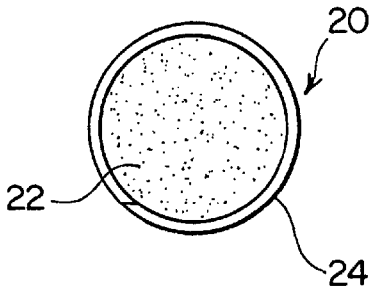

In another aspect as shown in FIGS. 2A and 2B, an amount of powder 22 of copper, copper alloy, or both is used to form the core of a wire 20 that has an outer cladding or sheath 24 of aluminum, aluminum alloy, zinc, and/or zinc alloy. It is within the scope of this invention to feed core material powder and sheath material powder to a spray apparatus instead of feeding wire.

Figure 3:
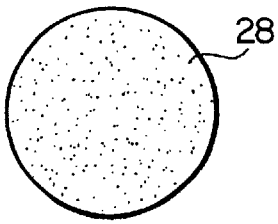
FIG. 3 is a cross-section view of a wire according to the present invention.

FIG. 3 shows a wire 28 according to the present invention which is formed by melting aluminum (and/or aluminum alloy), adding and melting copper (and/or copper alloy) to the aluminum melt, and forming rods which are then used to extrude the wire 28. Any suitable known wire forming or extrusion system may be used.

Figure 4:
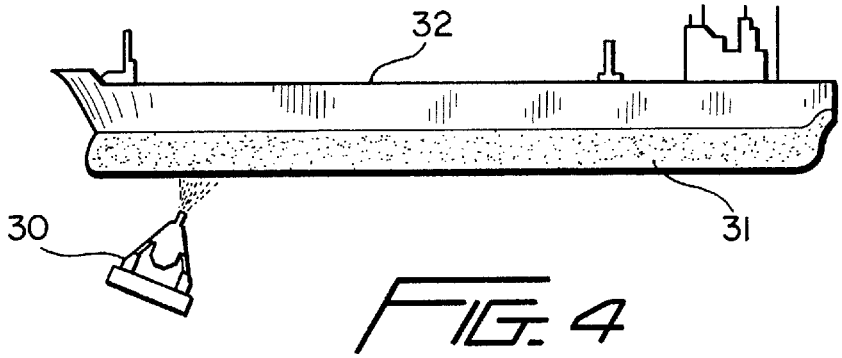
FIG. 4 shows schematically a process for applying a coating to a marine vessel with wire according to the present invention.

FIG. 4 shows schematically a method for applying a coating to an object using a wire according to the present invention. A thermal spray system 30 employing one, two, or more wires according to the present invention sprays a coating onto the hull 31 of a vessel 32. Preferably such a coating according to the present invention will range between 0.005 inches and 0.125 inches thick, although it is within the scope of this invention to employ coatings that are thinner or thicker. In one aspect a known twin wire arc spray system is used. Any object or item, including, but not limited to, boats, hulls, piers, docks, structures, buoys, cables, anchors, and any object or item subject to damage by marine growth may be coated according to the present invention.

When used as a coating for items or objects in a marine environment according to the present invention, the aluminum and/or aluminum alloy and/or zinc and/or zinc alloy in the coating acts as a cathode to produce a cathodic effect that inhibits corrosion. The copper or copper alloy acts as a biocide for marine growth such as barnacles, algae, and coral.

Figure 5A:
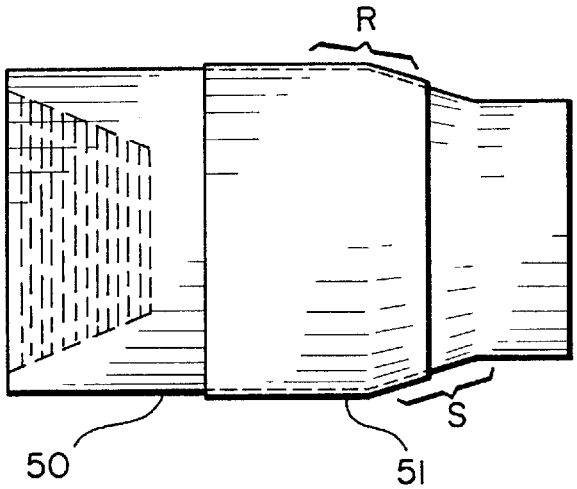
FIG. 5A is a side view and FIG. 5B is an end view of a tool joint according to the present invention.
Figure 5B:
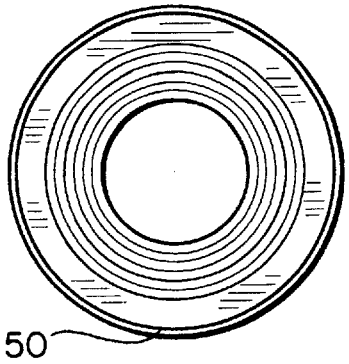

FIGS. 5A and 5B show a tool joint 50 with a coating 51 according to the present invention. It is within the scope of the present invention to coat the entire exterior surface of the tool joint 50 or only a portion thereof. The entire outer surface of the tool joint may be coated. In one particular aspect only the area "R" or "S" is coated according to the present invention. Alternatively, although not a legal equivalent of the spraying described herein, the tool joint 50 may be hardfaced employing any known hardfacing process. Any suitable known hardfacing process may be used. A drill pipe tool joint is the mechanism used to join the drill string together. One end is a male fitting called in the trade a "pin." The other is a female fitting called the "box" into which the pin screws. The joint is larger in diameter than the tube itself. When the two parts join together by threads, they form an assembly that must have greater tensile and fatigue strength than the tube body. In use the tool joint rubs against the drilled wall of a hole or against steel casing in the hole.

One current prior art practice is to weld a cladding on the exterior diameter of the tool joint. The cladding is a material that will resist abrasion caused by the rubbing action against the earthen wall of the hole or the steel casing. In one prior art method tungsten carbide is used in a matrix of steel. As the hole drilling progresses, the procedure is to "case," or insert, a smaller bore steel tube into the hole to drill deeper into the ground. The tungsten carbide wears against the casing and thins the wall, inviting rupture due to external or internal pressure. With this in mind drill pipe users have begun to clad the exterior of the tool joint with materials that are less abrasive to the casing but also less resistant to wear by the earth formation.

According to the present invention laser application of extremely fine carbides in a matrix of materials that has a low coefficient of friction are applied by a laser. The laser is controlled in a manner so as not to melt the carbides and place them into a solid-state solution to form an alloy with the matrix. Placing the carbides in solution with the suspension matrix changes the cladding's coefficient of thermal expansion and causes cracking to occur in the clad deposit. In one aspect according to the present invention the amount of cracking in the cladding is limited to keep foreign substances from penetrating the base metal.

In one aspect the carbides used are of any of the refractory carbide groups and combinations of the carbides, which become complex carbides, including but not limited to, titanium, zirconium, hafnium, vanadium, niobium, tantalum, chromium, molybdenum, and tungsten and the combinations of any or all of these. In one aspect the general geometric shape of the particles is spherical, but potato-shaped and angular-shaped can be used. The carbides may be held together with a binder such as cobalt, nickel, iron, or chromium, or can be used without a binder. The matrix that holds the carbides in place is, i one aspect, a good wear resistant material itself. It may be a cobalt based material, such as Stellite, or a nickel based material, as Colmonoy 5, or may be an iron based material, such as a high chromium iron.

In one aspect the bands of the cladding extend for 4–6 inches along the axis of the pipe on the box and 3–5 inches along the pin.

Figure 6A:
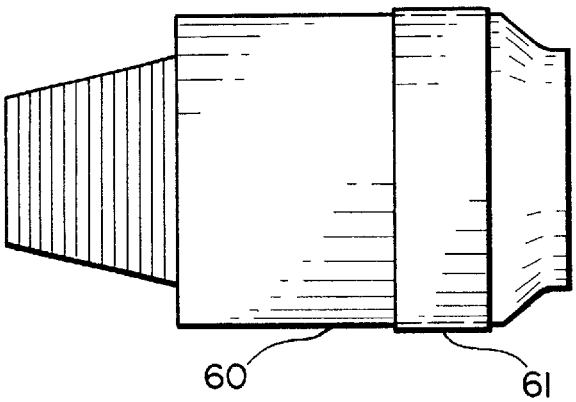
FIG. 6A is a side view and FIG. 6B is an end view of a tool joint according to the present invention.
Figure 6B:
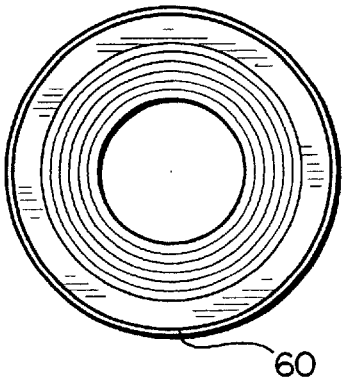

FIGS. 6A and 6B show a tool joint 60 with a coating 61 according to the present invention. It is within the scope of the present invention to coat the entire exterior surface of the tool joint 60 or only a portion thereof.

The present invention, therefore, provides in certain, but not necessarily all embodiments, a method for thermal spraying, the method including spraying a coating onto an object with a thermal spray system, the thermal spray system using wire to produce the coating, the wire comprising sheath material and core material, the core material acting as a biocide for marine growth and the sheath material acting as a cathode. Such a method may have one, some (in any possible combination) or all of the following: wherein the sheath material comprises 35% to 65% of the wire by weight, and the core material comprises 35% to 65% of the wire by weight; wherein the coating is between 0.010 inches and 0.020 inches thick; wherein the sheath material is from the group consisting of aluminum, aluminum alloy, zinc, and zinc alloy, and the core material is from the group consisting of copper and copper alloy; and/or wherein the object is the hull of a vessel.

The present invention, therefore, provides in certain, but not necessarily all embodiments, a wire for use in thermal spraying, the wire including aluminum material, and copper material. Such a method may have one, some (in any possible combination) or all of the following: wherein the aluminum material is aluminum; wherein the aluminum material is an aluminum alloy; wherein the aluminum material is a combination of aluminum and aluminum alloy; wherein the copper material is copper; wherein the copper material is a copper alloy; wherein the copper material is a combination of copper and copper alloy; wherein the aluminum material is 35% to 65% of the wire by weight, and the copper material is 35% to 65% of the wire by weight; the aluminum material is about 50% of the wire by weight, and the copper material is about 50% of the wire by weight; wherein the copper material is enclosed within the aluminum material; and/or wherein the copper material and aluminum material are intermingled together.

The present invention, therefore, provides in certain, but not necessarily all embodiments, a wire for use in thermal spraying, the wire having core material and sheath material, wherein the sheath material is from the group consisting of aluminum, aluminum alloy, zinc, and zinc alloy, and the core material is from the group consisting of copper and copper alloy.

The present invention, therefore, provides in certain, but not necessarily all embodiments, an object coated with a thermally sprayed-on coating, the spraying done by spraying a coating onto an object with a thermal spray system, the thermal spray system using source material to produce the coating, the source material comprising material acting as a cathode and material acting as a biocide. Such a method may have one, some (in any possible combination) or all of the following: wherein the source material is wire that includes sheath material that is 35% to 65% of the wire by weight, and the core material that is 35% to 65% of the wire by weight; and/or wherein the object is the hull of a vessel.

The present invention, therefore, provides in certain, but not necessarily all embodiments, a method for thermal spraying, the method including spraying a coating onto an object with a thermal spray system, the thermal spray system using powder to produce the coating, the powder including first material and second material, the second material acting as a biocide for marine growth and the first material acting as a cathode; and such a method wherein the first material is from the group consisting of aluminum, aluminum alloy, zinc, and zinc alloy, and the second material is from the group consisting of copper and copper alloy.

The present invention, therefore, provides in certain, but not necessarily all embodiments, a tool joint as disclosed herein and methods for cladding it.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for thermal spraying, the method comprising spraying a coating onto an object with a thermal spray system, the thermal spray system using wire to produce the coating, the wire comprising sheath material and core material, the sheath material encompassing the core material, the core material acting as a biocide for marine growth and the sheath material acting as a cathode to produce a cathodic effect that inhibits corrosion, the sheath material from the group consisting of aluminum, aluminum alloy, zinc, and zinc alloy, and the core material from the group consisting of copper and copper alloy, the sheath material comprising 35% to 65% of the wire by weight, and the sheath having a thickness ranging between 0.010 inches and 0.150 inches.

2. The method of claim 1 wherein the coating is between 0.010 inches and 0.020 inches thick.

3. The method of claim 1 wherein the object is the hull of a vessel.

4. The method of claim 1 wherein the sheath material is at least 95% aluminum by weight.

5. The method of claim 1 wherein the core material is at least 80% copper by weight.

6. The method of claim 1 wherein the core material ranges between 1% and 60% of total weight of the wire.

7. The method of claim 1 wherein the coating is between 0.010 inches and 0.020 inches thick, the object is the hull of a vessel, the sheath material is at least 95% aluminum by weight, and the core material is at least 80% copper by weight.

8. The method of claim 1 wherein the core material is powder.

9. The method of claim 1 wherein the core material is wire.

10. A method for thermal spraying, the method comprising spraying a coating onto an object with a thermal spray system, the thermal spray system using wire to produce the coating, the wire comprising sheath material and core material, the core material acting as a biocide for marine growth and the sheath material acting as a cathode to produce a cathodic effect that inhibits corrosion, and the sheath material from the group consisting of zinc and zinc alloy, and the core material from the group consisting of copper and copper alloy, the sheath material comprises 35% to 65% of the wire by weight, the coating is between 0.010 inches and 0.020 inches thick, the object is the hull of a vessel, the core material is at least 80% copper by weight, the core material ranges between 1% and 60% of total weight of the wire, and the sheath material has a thickness ranging between 0.010 inches and 0.150 inches.

* * * * *